US010087883B2

(12) United States Patent
Holsapple

(10) Patent No.: US 10,087,883 B2
(45) **Date of Patent: *Oct. 2, 2018**

(54) STIRLING ENGINE WITH REGENERATOR INTERNAL TO THE DISPLACER PISTON AND INTEGRAL GEOMETRY FOR HEAT TRANSFER AND FLUID FLOW

(71) Applicant: Alan Carl Holsapple, San Diego, CA (US)

(72) Inventor: Alan Carl Holsapple, San Diego, CA (US)

( * ) Notice: Subject to any disclaimer, the term of this patent is extended or adjusted under 35 U.S.C. 154(b) by 101 days.

This patent is subject to a terminal disclaimer.

(21) Appl. No.: 15/177,329

(22) Filed: Jun. 8, 2016

(65) Prior Publication Data

US 2016/0281638 A1 Sep. 29, 2016

Related U.S. Application Data

(63) Continuation-in-part of application No. 13/949,795, filed on Jul. 24, 2013, now Pat. No. 9,382,873.
(Continued)

(51) Int. Cl.
*F02G 1/04* (2006.01)
*F02G 1/057* (2006.01)
(Continued)

(52) U.S. Cl.
CPC ..... *F02G 1/057* (2013.01); *F02G 1/043* (2013.01); *F02G 1/055* (2013.01);
(Continued)

(58) Field of Classification Search
CPC ..... F02G 1/04; F02G 1/043; F02G 1/0435; F02G 1/044; F02G 1/053; F02G 1/055;
(Continued)

(56) References Cited

U.S. PATENT DOCUMENTS 2,045,118 A * 6/1936 Brown ..... H01H 43/285 200/34
3,405,521 A * 10/1968 Kelly ..... F02G 1/043 60/526
(Continued)

FOREIGN PATENT DOCUMENTS

DE 3006929 A1 * 10/1981 ..... F02G 1/043
JP 62126249 A * 6/1987 ..... F02G 1/0435
JP 06159836 A * 6/1994 ..... F02G 1/043

*Primary Examiner* — Laert Dounis

(57) ABSTRACT

A Stirling engine with internal regenerator and integral geometry for heat transfer and fluid flow has a displacer piston with a plurality of cavities traversing through the displacer piston and arranged in a specific cross sectional geometry. A heater head has heater fin protrusions that are arranged in the specific geometry, and a cooling bridge has cooler fin protrusions that are in the specific geometry. The displacer piston alternates between the heater head and the cooling bridge, with the cavities of the piston alternately enveloping the heater protrusions and the cooling protrusions, providing more efficient heat transfer to and from the working fluid. Each cavity in the displacer also contains a regenerator core, further improving heat transfer efficiency. The heater fin protrusions may also contain thermally conductive cores. A bellows assembly may also be used to seal the displacer piston from the heater head in order to reduce unswept volume.

18 Claims, 11 Drawing Sheets

Related U.S. Application Data

(60) Provisional application No. 61/675,106, filed on Jul. 24, 2012.

(51) Int. Cl.
*F02G 1/055* (2006.01)
*F02G 1/043* (2006.01)

(52) U.S. Cl.
CPC ..... *F02G 2243/02* (2013.01); *F02G 2255/20* (2013.01); *F02G 2256/02* (2013.01); *F02G 2257/00* (2013.01); *F02G 2270/30* (2013.01); *F02G 2280/10* (2013.01)

(58) Field of Classification Search
CPC .. F02G 1/057; F02G 2280/10; F02G 2270/30; F02G 2257/00; F02G 2256/00–2256/50; F02G 2255/00–2255/20; F02G 2254/20; F02G 2254/50; F02G 2243/02; F02G 2243/24

USPC ..... 60/516, 517, 520, 522, 526; 92/181 R–181 P
See application file for complete search history.

(56) References Cited

U.S. PATENT DOCUMENTS 3,407,593 A * 10/1968 Kelly ..... F02G 1/043 123/56.9
3,508,393 A * 4/1970 Kelly ..... F02G 1/055 60/526
3,523,427 A * 8/1970 Simpson ..... F02G 1/0445 60/526
3,579,980 A * 5/1971 Kelly ..... F02G 1/044 60/520
3,583,155 A * 6/1971 Schuman ..... F02G 1/0435 60/520
3,638,420 A * 2/1972 Kelly ..... F01B 1/12 60/526
3,807,904 A * 4/1974 Schuman ..... F01B 11/00 417/207
4,188,791 A * 2/1980 Mulder ..... F02G 1/0435 60/520
4,446,698 A * 5/1984 Benson ..... F02G 1/0435 60/517
4,511,805 A * 4/1985 Boy-Marcotte ..... F02G 1/0435 290/1 R
9,382,873 B2 * 7/2016 Holsapple ..... F02G 1/043
2004/0141291 A1 * 7/2004 Chen ..... F28F 3/02 361/704
2011/0239640 A1 * 10/2011 Charlat ..... F02G 1/053 60/517
2012/0073284 A1 * 3/2012 Chen ..... F02G 1/053 60/524

* cited by examiner

STIRLING ENGINE WITH REGENERATOR INTERNAL TO THE DISPLACER PISTON AND INTEGRAL GEOMETRY FOR HEAT TRANSFER AND FLUID FLOW

The current application is a continuation-in-part (CIP) application of the U.S. non-provisional application Ser. No. 13/949,795 filed on Jul. 24, 2013. The U.S. non-provisional application Ser. No. 13/949,795 claims a priority to a U.S. provisional application Ser. No. 61/675,106 filed on Jul. 24, 2012.

FIELD OF THE INVENTION

The present invention relates generally to power generation. More particularly, the present invention relates to a design for a more efficient Stirling engine.

BACKGROUND OF THE INVENTION

In the modern world, technology is everywhere. At any given time, a person probably has in their field of view an object that was manufactured at a factory. Computers, cell phones, cars, and even to a large extent the food many people eat has been part of a lengthy production line. Many things are required to produce the finished products we see today, such as manpower and infrastructure, but possibly the most important piece of modern production is power. Many different types of machines are utilized in the manufacturing and packaging of a product, and they all require mechanical work to accomplish their goal. Some machines are entirely mechanical, such as a simple steam engine, but in the modern world most machines depend on electrical components and power to achieve optimal functioning as well. Electrical power is also integral to virtually all aspects of life in developed countries, with applications from refrigerating food to operating televisions, computers, radios, and other appliances, to operating traffic signals, among many others.

Electricity generation is the process of generating electric energy from other forms of energy. The fundamental principle of electricity generation is known as Faraday's law, and it can be used to generate electricity by the movement of a loop of wire or disc of copper between the poles of a magnet. This method of converting mechanical energy into electricity can be utilized in a number of different ways, including utilizing falling water or human power to turn a turbine, using a combustion engine to turn a crank, or using a heat source to power an engine, such as with a type of engine known as a Stirling engine.

In the modern world, it is desirable to discover and develop clean, renewable sources of energy. Of particular interest to many is the harnessing of naturally occurring energy sources. If the energy is there already in one form or another such as motion or radiation, constructing apparatuses to convert such energy into electricity is essentially generating free power, aside from the construction, maintenance and operational costs, since the resource used to generate the power is not one that can be purchased. One such energy source is hydroelectric power, which harnesses the natural motion of water, such as an ocean current or a waterfall, to generate electricity. Another, similar source of "free" energy is wind power. Yet another widely considered option for renewable energy is solar power, which harnesses the energy in sunlight to produce electrical power. Many solar power generation installations utilize photovoltaic technology to convert sunlight into electricity, while others utilize concentrated solar power to provide a heat source for a conventional power plant. One such application utilizes a Stirling engine.

A Stirling engine is a heat engine that operates by cyclic compression and expansion of a working fluid at different temperature levels so that there is a net conversion of heat energy to mechanical work. The Stirling engine is traditionally classified as an external combustion engine like the steam engine since all heat transfers occur through a solid boundary. This contrasts with an internal combustion engine where heat input is by combustion of a fuel within the body of the working fluid. Typical of heat engines, the general cycle consists of compressing cool gas, heating the gas, expanding the hot gas, and finally cooling the gas before repeating the cycle. The efficiency of the process is narrowly restricted by the efficiency of the Carnot cycle, which depends on the temperature difference between the hot and cold reservoir. Advantages of the Stirling engine are that it is highly efficient compared to steam engines, its operation is relatively quiet, and it can easily use almost any heat source. This compatibility with alternative and renewable energy sources has become increasingly significant as the price of conventional fuels rises, and also in light of concerns such as peak oil and climate change.

Current Stirling engine designs are subject to cracking of the heater tubes and external regenerator due to high thermal stress. In addition, pumping losses are high. Designing Stirling engine heat exchangers is a balance between high heat transfer with low viscous pumping losses and low dead space, or unswept internal volume. By eliminating the heater tubes, the heat transfer process is more directly associated with the working gas as it dwells in the heater head. By adding an internal regenerator to the displacer piston, the working fluid is utilized more efficiently and unswept volume is reduced. In addition, stresses in the heater head and regenerator assembly are reduced, allowing high temperature ceramics to be utilized, which significantly increases the efficiency of the engine because the efficiency is dependent on the difference in temperature between the hot and cold sections.

In a Stirling engine, the regenerator is an internal heat exchanger and provides temporary heat storage between the hot and cold spaces such that the working fluid passes through it first in one direction and then the other. Its function is to retain heat within the system that would otherwise be exchanged with the environment at temperatures intermediate to the maximum and minimum temperatures, increasing the thermal efficiency of the engine by recycling internal heat which would otherwise be lost.

One application well suited to the present invention is in waste heat recovery. The present invention may use waste heat from other mechanical, electrical or other devices such as another generator or a peak shaver which would otherwise be discarding useful heat energy. Ideally, the present invention would be used for waste heat recovery in continuously running applications.

It is therefore an object of the present invention to provide a Stirling engine displacer piston with an internal regenerator and integral geometry for more efficient heat transfer and fluid flow, ultimately resulting in a more highly efficient Stirling engine.

DETAIL DESCRIPTIONS OF THE INVENTION

All illustrations of the drawings are for the purpose of describing selected versions of the present invention and are not intended to limit the scope of the present invention.

Figure 1:
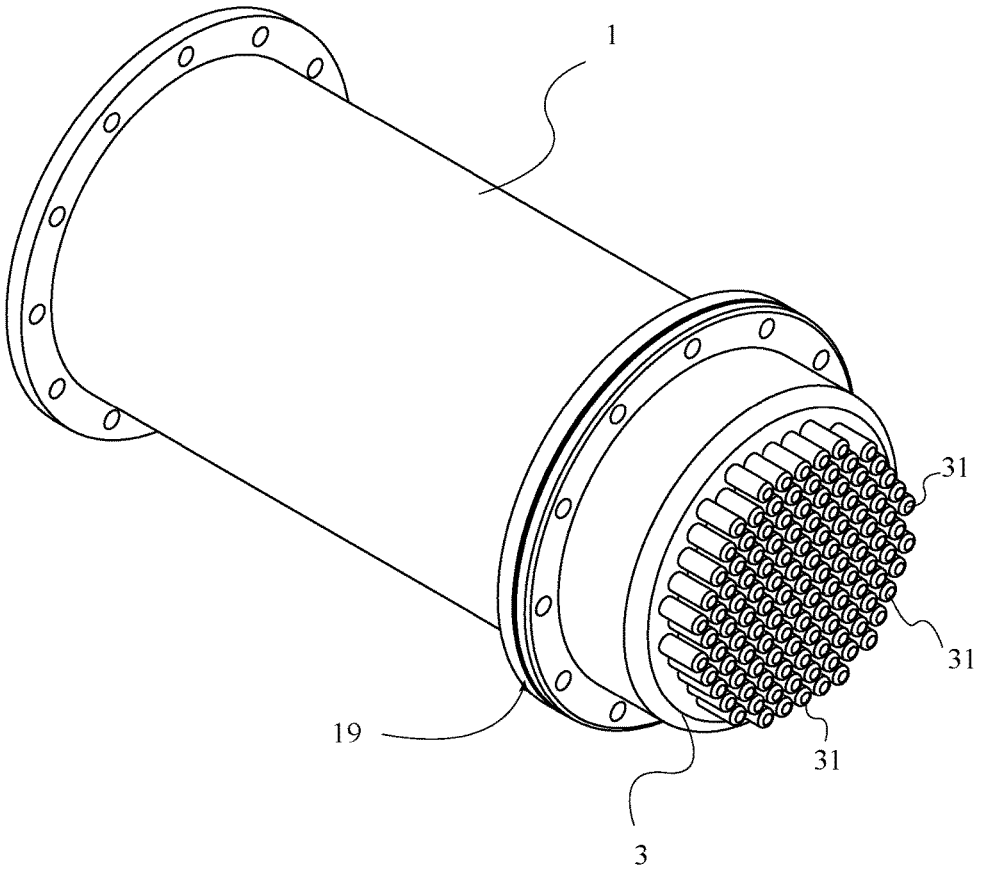
FIG. 1 is a perspective view of the exterior of the present invention.
Figure 2:
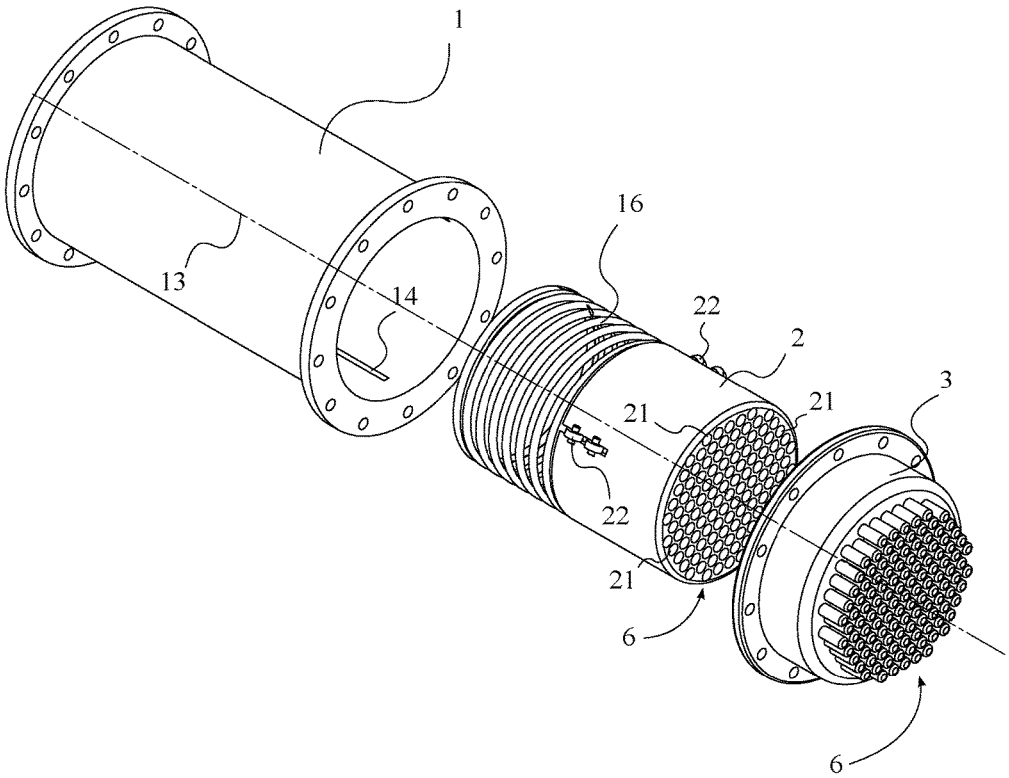
FIG. 2 is a perspective exploded view of the present invention.
Figure 3:
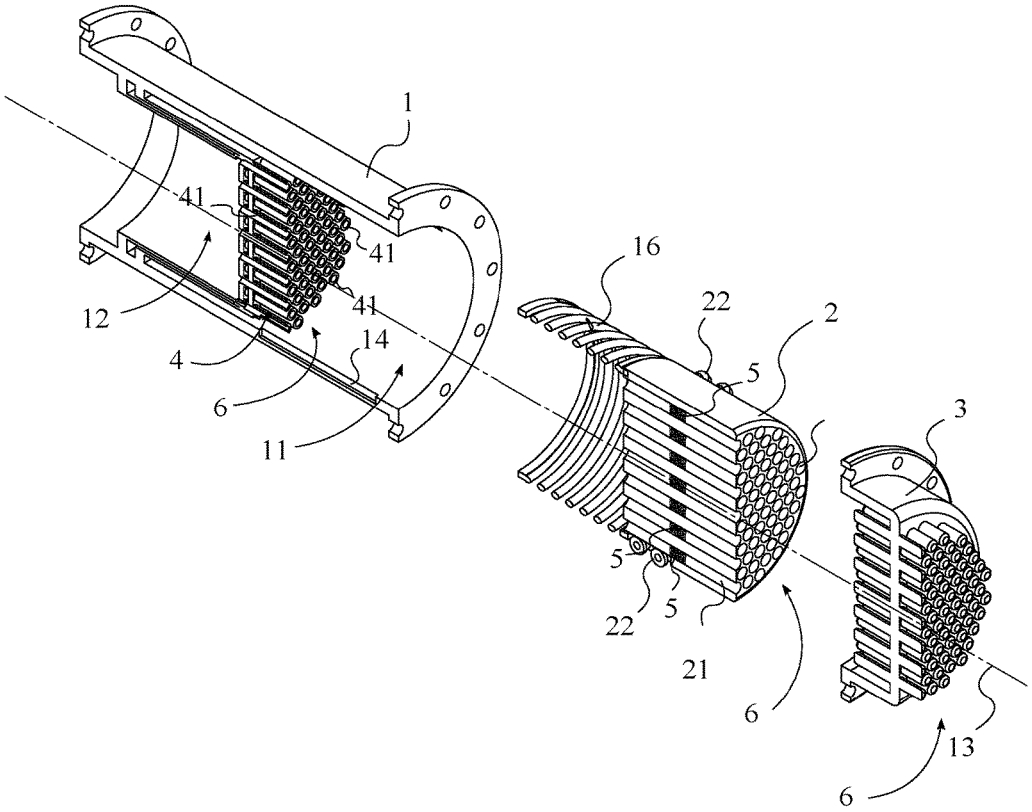
FIG. 3 is a perspective exploded cross sectional view of the present invention.
Figure 4:
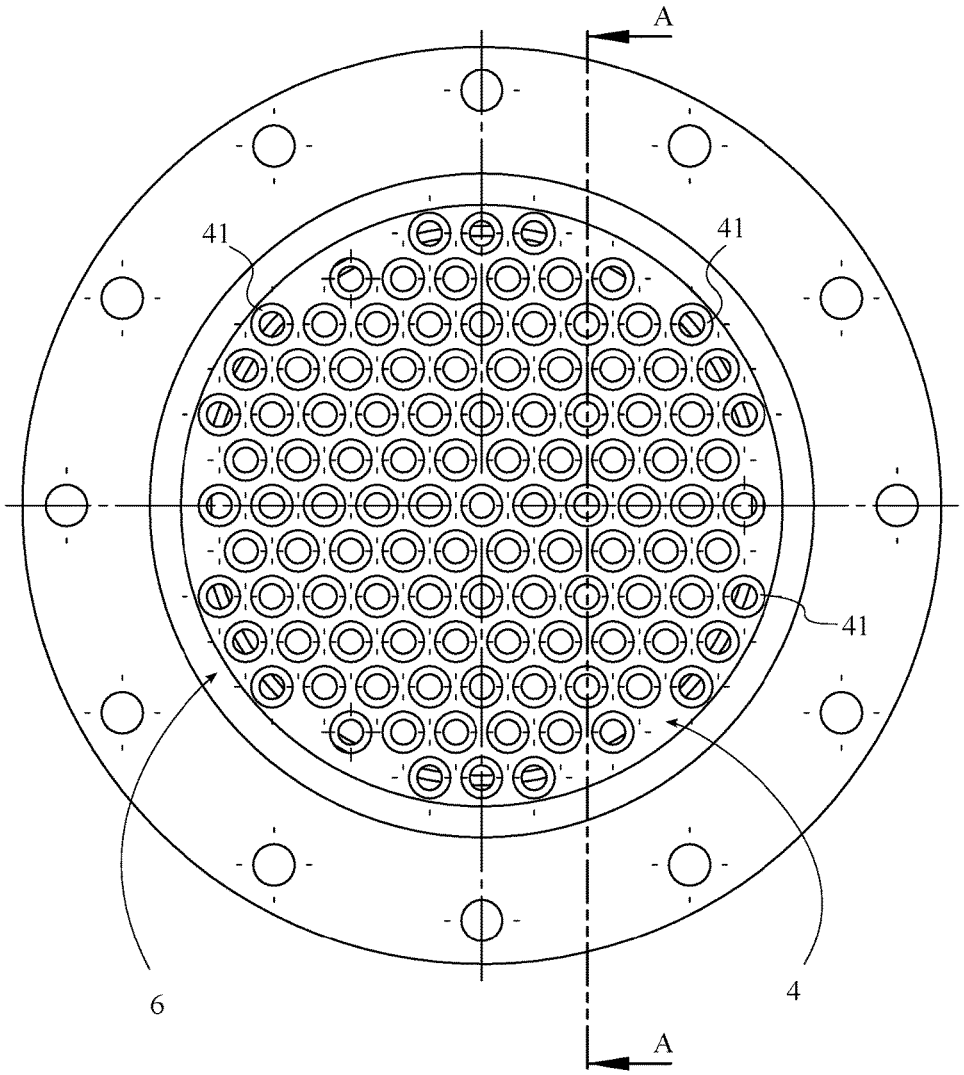
FIG. 4 is a head-on view of the cooling bridge inside the cylindrical housing.
Figure 5:
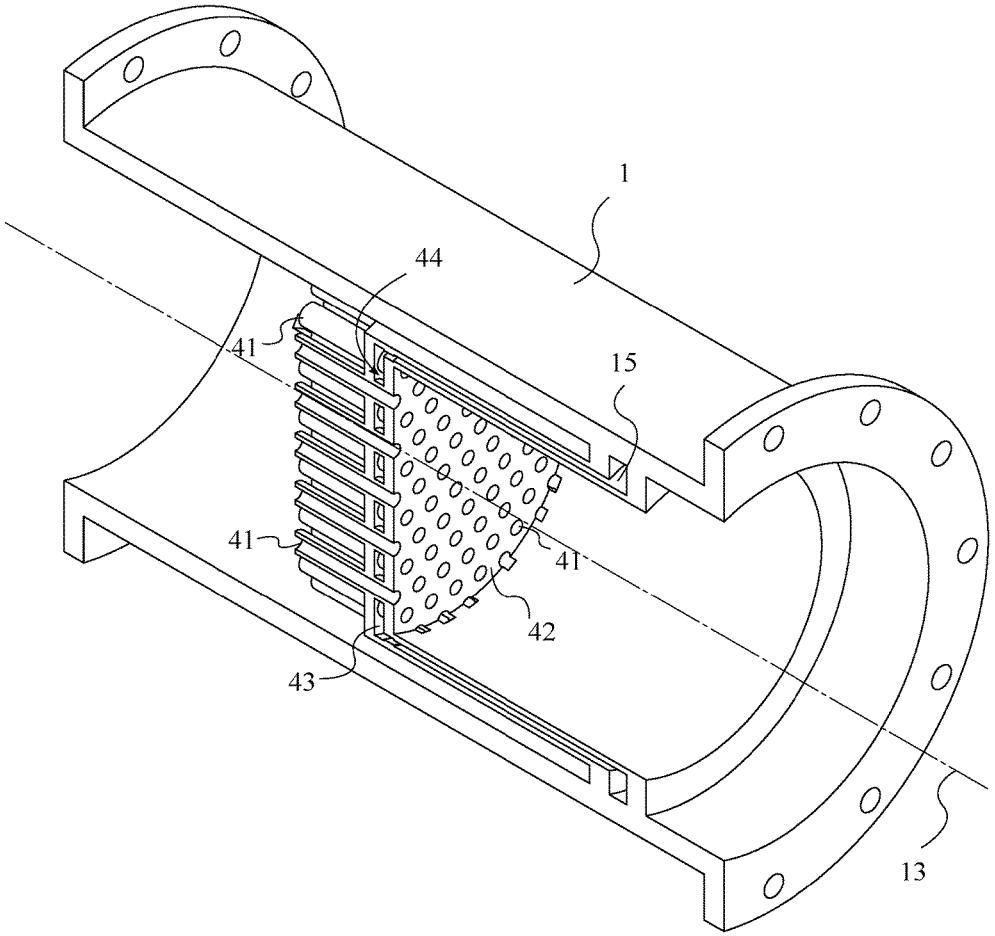
FIG. 5 is a perspective view of the cooling bridge and the cylindrical housing with a sectional cut along line A-A from FIG. 4.

The present invention is a modification for a Stirling engine which incorporates an internal regenerator and integral geometry for improved heat transfer and fluid flow. Referring to FIGS. 1-3, in general, the present invention comprises a cylindrical housing 1, a displacer piston 2, a heater head 3, a cooling bridge 4, and a plurality of regenerator cores 5.

The cylindrical housing 1 is the substantial physical structure that contains the majority of the present invention as is typical with Stirling engines. The cylindrical housing 1 comprises a piston chamber 11 and contains a working fluid 7. The working fluid 7 is preferably a gas, such as, but not limited to, hydrogen, helium, or air. A central axis 13 centrally traverses through the cylindrical housing 1, and defines a longitudinal direction. The displacer piston 2 is comprises a plurality of cavities 21, the heater head 3 comprises a plurality of heater fin protrusions 31, and the cooling bridge 4 comprises a plurality of tubular cooler fin protrusions 41.

The displacer piston 2 is cylindrical and is concentrically positioned within the piston chamber 11 of the cylindrical housing 1 between the heater head 3 and the cooling bridge 4. Each of the plurality of cavities 21 is oriented parallel to the central axis 13 and fully traverses through the displacer piston 2. As seen in FIGS. 2-3, the plurality of cavities 21 are arranged in a specific cross sectional geometry 6. The specific cross sectional geometry 6 may be any desired cross sectional geometry, and is defined in order to make certain that cross sectional geometries for the plurality of cavities 21, the plurality of heater fin protrusions 31 and the plurality of tubular cooler fin protrusions 41 are the same. In one embodiment of the present invention, in the specific cross sectional geometry 6, the plurality of cavities 21 are equally distributed across a cross section of the displacer piston 2 so that a large portion of the cross section is empty space, with numerous holes separated by relatively thin portions of material. The primary goal of having numerous distributed geometrical elements of negative space is to maximize surface area within the displacer piston, improving heat transfer and fluid flow. As cavities within the displacer piston 2 and corresponding mating protrusions on the heater head 3 and the cooling bridge 4 increase in number, overall surface area for heat transfer is increased, resulting in quicker and more efficient heat transfer and improved overall thermal efficiency.

Figure 7:
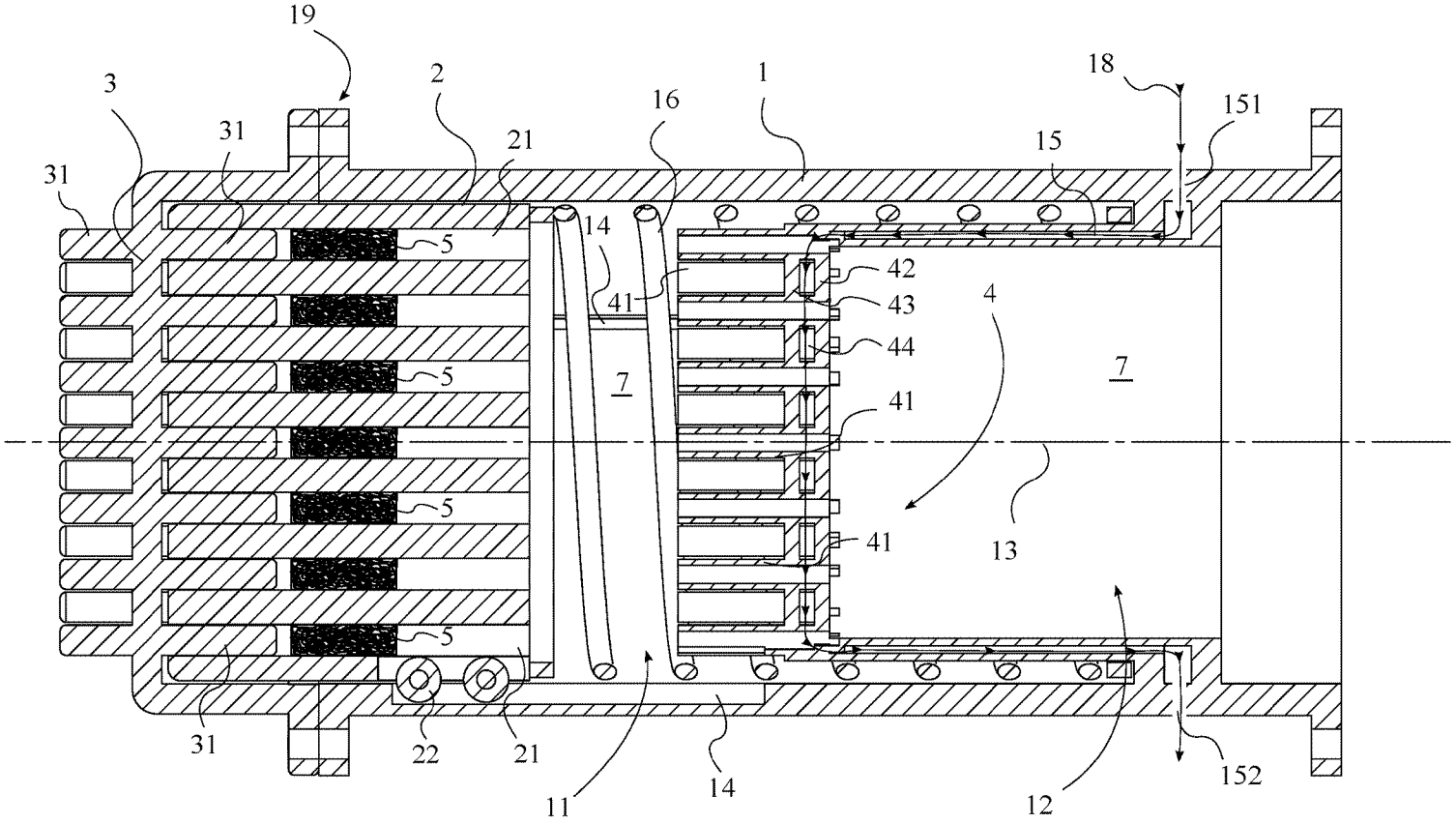
FIG. 7 is a side sectional view of the entire assembly of the present invention with the displacer piston at the heater head.
Figure 8:
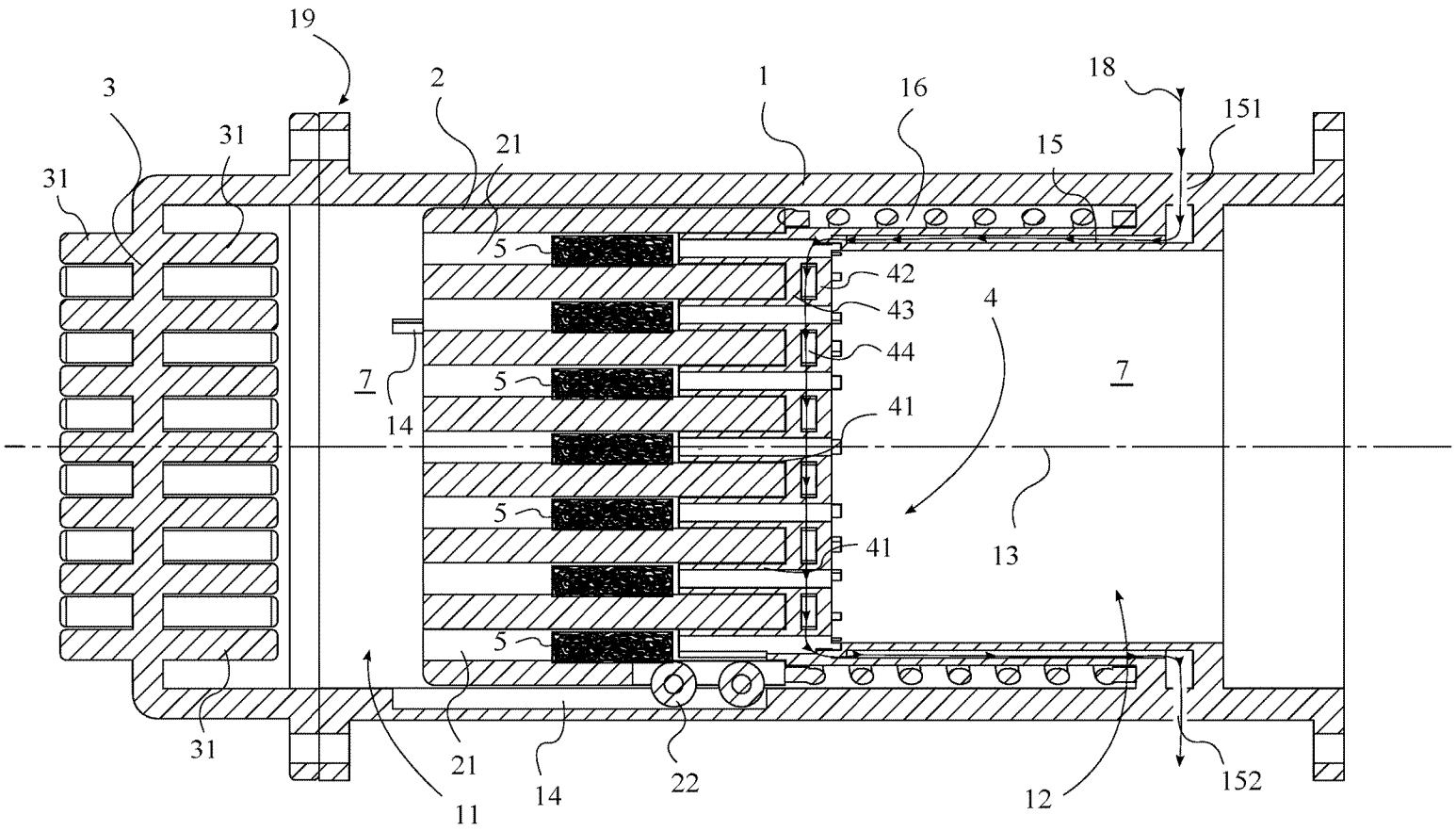
FIG. 8 is a side sectional view of the entire assembly of the present invention with the displacer piston at the cooling bridge.

As seen in FIGS. 3, 7 and 8, each of the plurality of regenerator cores 5 is a portion of material which is able to receive and transfer heat energy quickly. The plurality of regenerator cores 5 is centrally positioned within the plurality of cavities 21, such that one of the plurality of regenerator cores 5 is positioned within each of the plurality of cavities 21. In one embodiment, each of the plurality of regenerator cores 5 is positioned centrally within the displacer piston 2, such that the displacer piston 2 is symmetric about the plurality of regenerator cores 5. In alternate embodiments, however, the plurality of regenerator cores 5 may be longitudinally offset within the plurality of cavities 21. The plurality of regenerator cores 5 traverse substantially less longitudinal distance than the plurality of cavities 21 so that the plurality of cavities 21 may receive the plurality of heater fin protrusions 31 and the plurality of tubular cooler fin protrusions 41 on opposing longitudinal sides of the displacer piston 2.

In one embodiment of the present invention, each of the plurality of regenerator cores 5 is made of thin, highly convoluted, compressed metal wire, similar to steel wool. This allows the plurality of regenerator cores 5 to maximize surface area available to receive and store heat energy while remaining porous. In one embodiment of the present invention, the displacer piston 2 is made with the plurality of regenerator cores 5 being positioned within the plurality of cavities 21 during manufacture. In an alternate embodiment of the present invention, the plurality of regenerator cores 5 is positioned within the plurality of cavities 21 by pressing an amount of regenerator core material into each of the plurality of cavities 21 from one opening of the fin cavity. In another alternate embodiment, two halves of the displacer piston 2 are brought together to sandwich a disc of regenerator core material between the two halves.

The heater head 3 is concentrically positioned with the cylindrical housing 1 and traverses into the piston chamber 11 along the central axis 13. In one embodiment of the present invention, the heater head 3 itself is a physically separate component which is affixed to the cylindrical housing 1 by a cylindrical flange interface 19 between the heater head 3 and the cylindrical housing 1. A bolt pattern is radially spaced out around the cylindrical axis on the cylindrical flange interface 19, through which a plurality of bolts may be affixed in order to attach the heater head 3 to the cylindrical housing 1.

As can be seen in FIGS. 1, 2, 3, 7 and 8, each of the plurality of heater fin protrusions 31 is oriented parallel to the central axis 13. The plurality of heater fin protrusions 31 is arranged to match the specific cross sectional geometry 6 such that the plurality of heater fin protrusions 31, having a positive geometry, may interface with the plurality of cavities 21, which have negative geometry, so that the plurality of heater fin protrusions 31 may be enveloped by the plurality of cavities 21 by moving the displacer piston 2 along the central axis 13. The plurality of heater fin protrusions 31 is heated by a heat source from outside the cylindrical housing 1, such as, but not limited to, a natural gas flame, a burner section, a diesel oil burner, or another heat source.

Figure 10:
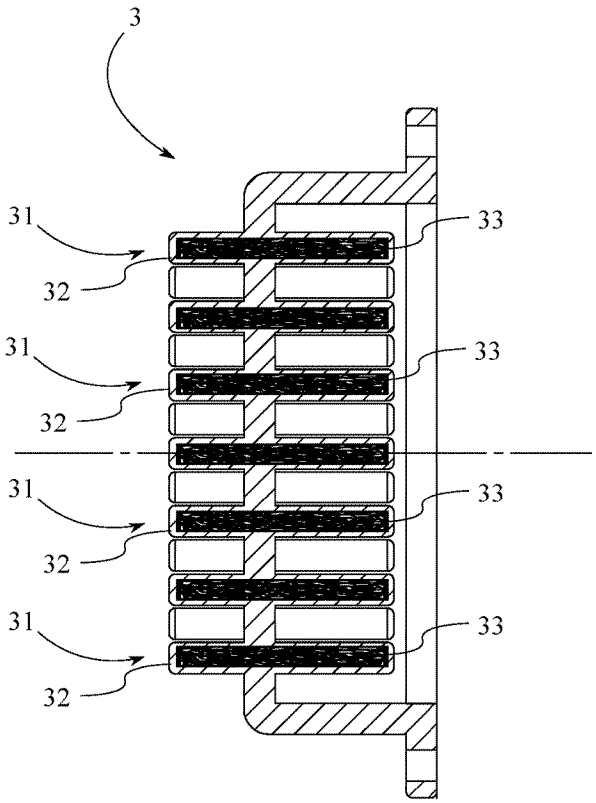
FIG. 10 is a side sectional view of the heater head showing the internal thermally conductive cores of the heater fin protrusions.

It is desirable for the plurality of heater fin protrusions to be highly thermally conductive to facilitate efficient transfer of heat from the heat source outside of the cylindrical housing to the working fluid inside the cylindrical housing. Therefore, in one embodiment shown in FIG. 10, each of the plurality of heater fin protrusions comprises an outer casing 32 and a thermally conductive core 33. The outer casing 32 acts as a casing enclosing the thermally conductive core 33. Preferably, the thermally conductive core 33 traverses the majority of the length of the heater fin protrusions. The coefficient of thermal expansion of the outer casing 32 and the coefficient of thermal expansion of the thermally conductive core 33 should be approximately equivalent to avoid stresses caused by different rates of expansion or contraction between the outer casing 32 and the thermally conductive core 33. The material of the outer casing 32 of each of the heater fin protrusions should be a high temperature alloy, such as, but not limited to, copper. In one embodiment, the thermally conductive cores 33 are similar in material and arrangement to the plurality of regenerator cores within the displacer piston, being thin, highly convoluted, compressed metal wire. In one embodiment, the thermally conductive cores 33 are made from a solid material.

The cooling bridge 4 is concentrically positioned within the cylindrical housing 1 opposite the heater head 3 along the piston chamber 11. Similarly to the plurality of heater fin protrusions 31, each of the plurality of tubular cooler fin protrusions 41 is oriented parallel to the central axis 13. The plurality of tubular cooler fin protrusions 41 is arranged to match the specific cross sectional geometry 6 such that the plurality of tubular cooler fin protrusions 41, having a positive geometry, may interface with the plurality of cavities 21, which have negative geometry, so that the plurality of tubular cooler fin protrusions 41 may be enveloped by the plurality of cavities 21 by moving the displacer piston 2 along the central axis 13. In one embodiment of the present invention, each of the plurality of tubular cooler fin protrusions 41 is hollow to allow working fluid 7 to pass through.

The displacer piston 2 and the cylindrical housing 1 are dimensioned such that there is only a small gap between the displacer piston 2 and the cylindrical housing 1. The displacer piston 2 oscillates between the heater head 3 and the cooling bridge 4 and alternatingly displaces the working fluid 7 between the heater head 3 and the cooling bridge 4. The plurality of cavities 21 alternatingly envelops the plurality of heater fin protrusions 31 and the plurality of tubular cooler fin protrusions 41 as the displacer piston 2 moves between the heater head 3 and the cooling bridge 4. When the fin cavities of the displacer piston 2 are enveloping the plurality of heater fin protrusions 31 of the heater head 3, the majority of the working fluid 7 is displaced away from the heater head 3, towards the cooling bridge 4, and the cooling bridge 4 cools the working fluid 7, causing the pressure of the working fluid 7 to drop. When the plurality of cavities 21 of the displacer piston 2 are enveloping the plurality of tubular cooler fin protrusions 41 of the cooling bridge 4, the working fluid 7 is displaced towards the heater head 3, where the working fluid 7 is heated by the heater head 3, causing the pressure of the working fluid 7 to rise.

In one embodiment of the present invention, the displacer piston 2 is connected to a crank mechanism according to a beta type Stirling engine design. In one embodiment of the present invention, however, the displacer piston 2 is a free piston design. The following is a description of the preferred free piston embodiment.

Figure 9:
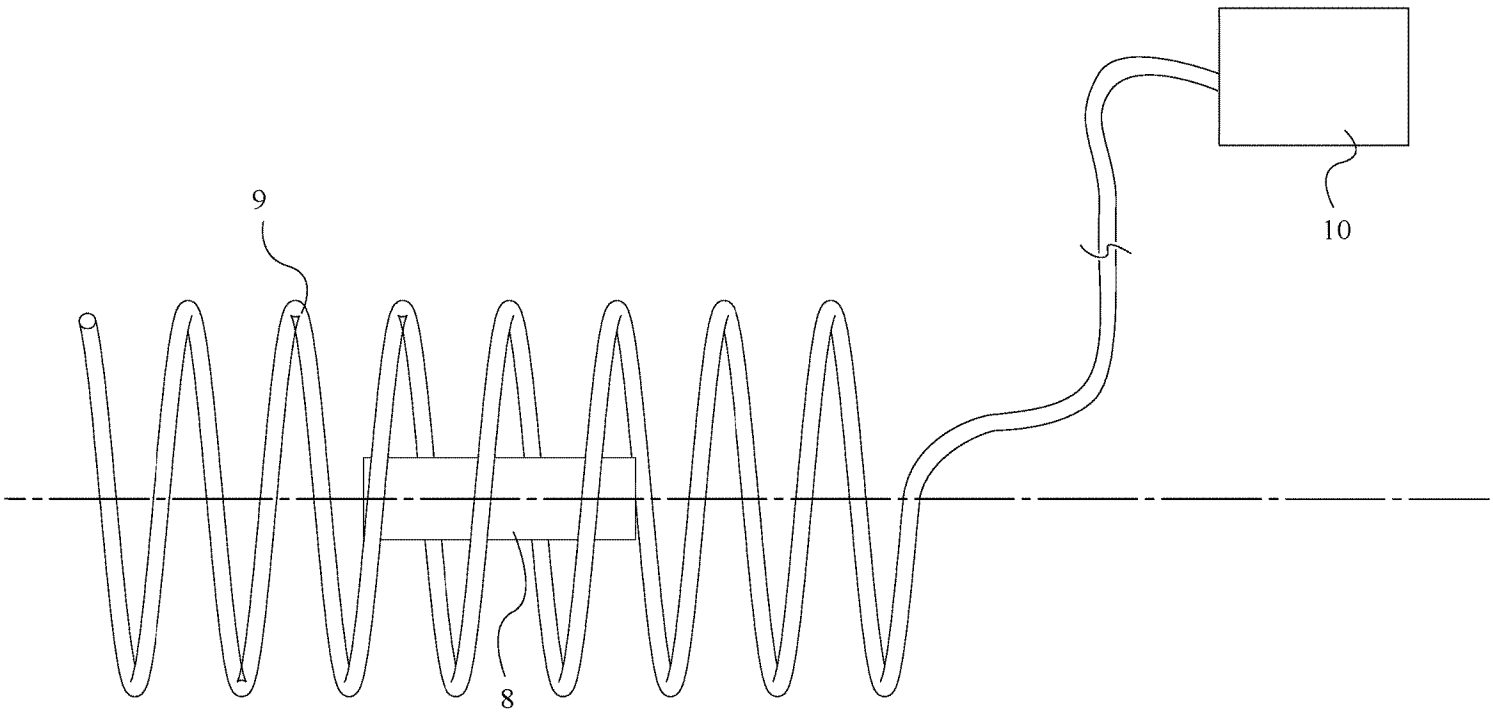
FIG. 9 is an illustration of one method of controlling the position of the displacer piston with a ferrous material and an electrically conductive coil.

In one embodiment, the present invention further comprises a ferrous or magnetic material 8, an electrically conductive coil 9, and a spring 16. The ferrous or magnetic material 8 is integrated into the displacer piston 2, preferably close to the circumference of the displacer piston 2. The electrically conductive coil 9 is wrapped around the cylindrical housing 1. The electrically conductive coil 9 is electrically connected to an electronic control system 10. The electronic control system 10 controls electronic current flow through the electrically conductive coil 9 in order to produce an electromagnetic field, creating a force in the ferrous or magnetic material 8 and thus moving the displacer piston 2. This arrangement is similar to the function of a solenoid. FIG. 9 shows a conceptualization of the use of the ferrous or magnetic material 8, the electrically conductive coil 9 and the electronic control system 10.

The spring 16 is connected between the displacer piston 2 and a spring annulus 17. The spring annulus 17 is positioned concentrically within the cylindrical housing 1, opposite the heater head 3 along the cylindrical housing 1. In one embodiment, the cooling bridge 4 is positioned between the displacer piston 2 and the spring annulus 17 and there is a concentric gap between the cooling bridge 4 and the cylindrical housing 1, so that the spring 16 encircles the cooling bridge 4.

The displacer piston 2 requires physical support to hold the displacer piston 2 in the correct concentric position within the cylindrical housing 1. To this end, the cylindrical housing 1 further comprises a plurality of roller tracks 14, wherein each of the plurality of roller tracks 14 is oriented parallel to the central axis 13. The plurality of roller tracks 14 is radially distributed around the central axis 13 within the cylindrical housing 1. The displacer piston 2 further comprises a plurality of rollers 22. The plurality of rollers 22 is similarly radially distributed around the central axis 13 on the displacer piston 2, so that the plurality of rollers 22 are engaged to the plurality of roller tracks 14, wherein the plurality of rollers 22 roll within the plurality of roller tracks 14 in a direction parallel to the central axis 13. As the displacer piston 2 moves longitudinally within the cylindrical housing 1, the plurality of rollers 22 and the plurality of roller tracks 14 ensure that the displacer piston 2 stays concentric with the cylindrical housing 1 and does not rotate.

Figure 6:
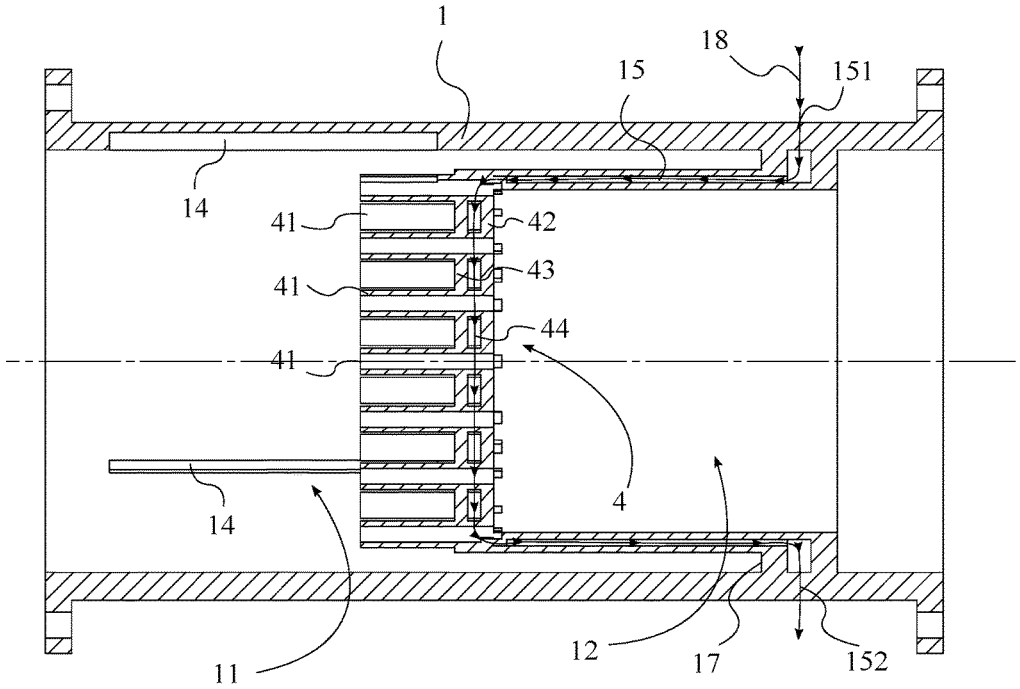
FIG. 6 is a side sectional view of the cooling bridge and the cylindrical housing.

As seen in FIGS. 6-8, in one embodiment of the present invention, the cooling bridge 4 is cooled by a circulatory fluid flow using a coolant fluid 18. The following is a description of an example of a cooling arrangement according to one embodiment. In alternate embodiments, other means may be used for cooling the cooling bridge 4.

The cylindrical housing 1 further comprises an annular coolant chamber 15 and a working fluid chamber 12. The cooling bridge 4 is positioned between the piston chamber 11 and the working fluid chamber 12. The cooling bridge 4 further comprises a first circular plate 42 and a second circular plate 43. The first circular plate 42 and the second circular plate 43 are concentrically positioned within the cylindrical housing 1.

The first circular plate 42 and the second circular plate 43 are spaced apart from each other along the central axis 13. A cooling space 44 is defined by all empty space between the first circular plate 42 and the second circular plate 43. The plurality of tubular cooler fin protrusions 41 traverses through the first circular plate 42 and the second circular plate 43. As a result, the working fluid 7 may pass through the plurality of tubular cooler fin protrusions 41 so that the working fluid chamber 12 is in fluid communication with the piston chamber 11 through the plurality of tubular cooler fin protrusions 41. The annular coolant chamber 15 is concentrically positioned around the working fluid chamber 12 and is separated from the working fluid chamber 12 so that the coolant fluid 18 and the working fluid 7 are not allowed to mix. The annular coolant chamber 15 comprises a coolant ingress 151 and a coolant egress 152. The coolant ingress 151 is in fluid communication with the coolant egress 152 through the cooling space 44. Coolant flows into the coolant ingress 151 and through the cooling space 44, and heat transfer occurs between the working fluid 7 within the plurality of tubular cooler fin protrusions 41. The coolant fluid 18 should always be at a lower temperature than the working fluid 7, so that the cooling bridge 4 is constantly cooling the working fluid 7 similarly to how the heater head 3 is constantly heating the working fluid 7.

Figure 11:
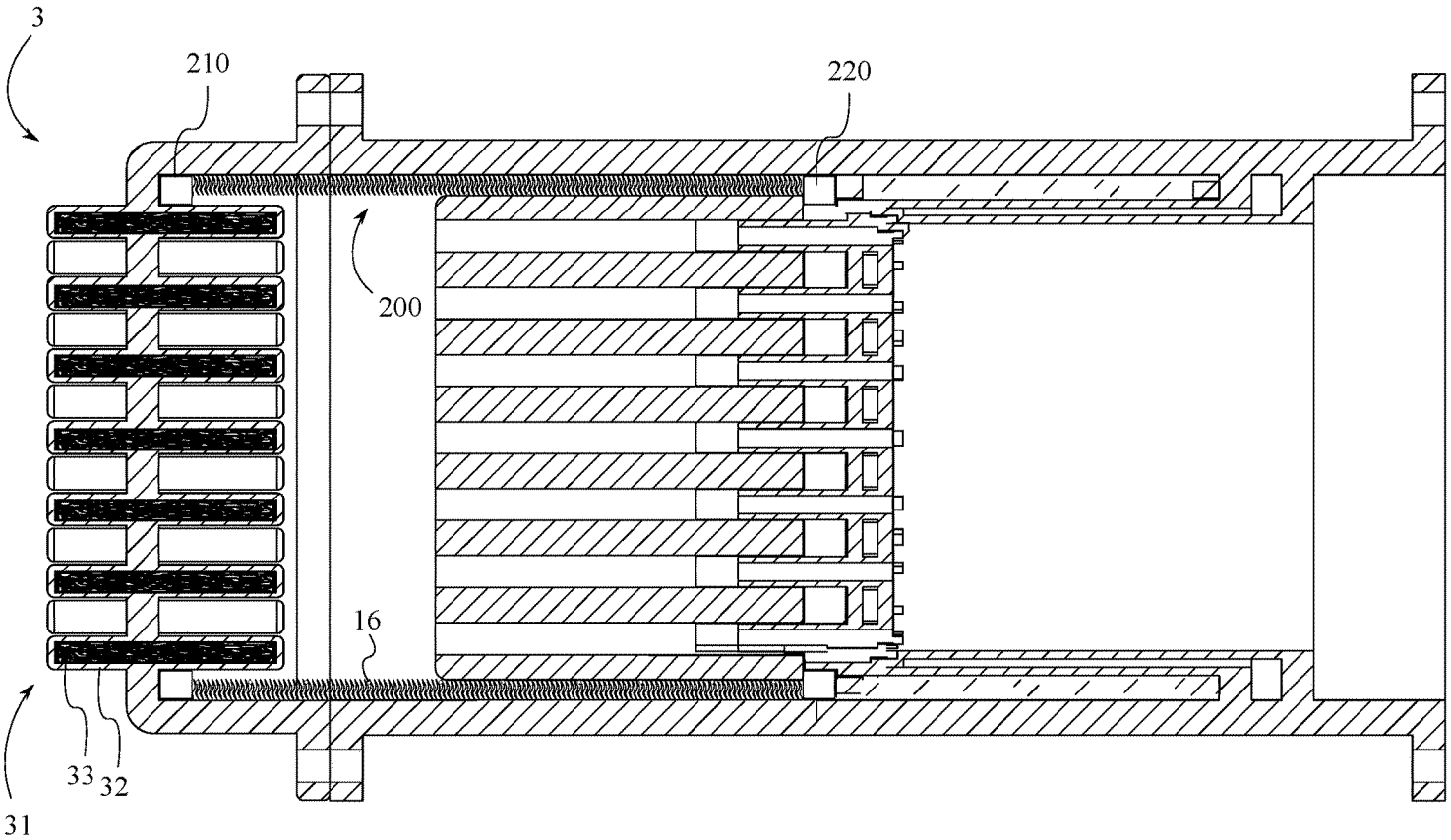
FIG. 11 is a side sectional view of the assembly of the present invention incorporating a bellows assembly as a seal between the displacer piston and the internal wall of the cylindrical housing.

Referring to FIG. 11, one embodiment of the present invention further comprises a bellows assembly 200. In one embodiment, the bellows assembly 200 is an edge welded bellows. In one embodiment, the bellows assembly 200 is a formed bellows. The bellows assembly 200 is an elastic vessel that can be compressed and extended under varying pressure or vacuum conditions. The bellows assembly 200 serves as a seal between the heater head and the displacer piston. The integration of the bellows assembly 200 reduces unswept volume within the piston chamber in order to increase the overall efficiency of the system, since a smaller volume of working fluid experiences less overall energy exchange during the heating and cooling cycles to achieve the same effect. The bellows assembly 200 comprises a first end 210 and a second end 220 which are positioned opposite each other along the bellows assembly 200, being the longitudinal extremities of the bellows assembly 200. The first end 210 of the bellows assembly 200 is annularly connected within the piston chamber adjacent to the heater head. The second end 220 of the bellows assembly 200 is annularly connected to the end of the displacer piston that is closer to the cooling bridge, thus sealing the displacer piston within the bellows assembly 200. The first end 210 of the bellows assembly 200 stays stationary, being connected to the inside of the cylindrical housing, while the second end 220 of the bellows assembly 200 reciprocates back and forth with the movement of the displacer piston.

In one embodiment, the spring 16 is integrated into the bellows assembly 200, with the spring being wound within the bellows assembly 200 from the first end 210 to the second end 220 of the bellows assembly 200. Similarly, in one embodiment, the electrically conductive coil is wound within the bellows assembly 200 from the first end 210 to the second end 220. In various embodiments, the spring, the electrically conductive coil, or both, may be integrated into or within the bellows assembly 200 in any conceivable manner, or embodied as separate components that are attached, connected, placed adjacent to or otherwise arranged together with, within, or around the bellows assembly 200, or in any other means, in order to facilitate adequate movement of the displacer piston within the cylindrical housing. Although the invention has been explained in relation to its preferred embodiment, it is to be understood that many other possible modifications and variations can be made without departing from the spirit and scope of the invention as hereinafter claimed.

What is claimed is:

1. A Stirling engine comprising:

a cylindrical housing;

a displacer piston;

a heater head;

a cooling bridge;

a plurality of regenerator cores;

coolant fluid;

a bellows assembly;

the cylindrical housing comprising a piston chamber;

a working fluid being contained within the cylindrical housing;

a central axis centrally traversing through the cylindrical housing;

the displacer piston comprising a plurality of cavities;

the heater head comprising a plurality of heater fin protrusions;

the cooling bridge comprising a plurality of tubular cooler fin protrusions;

the plurality of cavities being arranged in a specific cross sectional geometry;

the plurality of heater fin protrusions being arranged to match the specific cross sectional geometry;

the plurality of tubular cooler fin protrusions being arranged to match the specific cross sectional geometry;

the plurality of regenerator cores being centrally positioned within the plurality of cavities;

the cooling bridge being cooled by a circulatory fluid flow using the coolant fluid;

the cylindrical housing comprising an annular coolant chamber and a working fluid chamber;

the cooling bridge being positioned between the piston chamber and the working fluid chamber;

the cooling bridge comprising a first circular plate and a second circular plate;

the first circular plate and the second circular plate being concentrically positioned with the cylindrical housing;

the first circular plate and the second circular plate being spaced apart from each other along the central axis;

a cooling space being all empty space enclosed between the first circular plate and the second circular plate;

the plurality of tubular cooling protrusions traversing through the first circular plate and the second circular plate;

the working fluid chamber being in fluid communication with the piston chamber through the plurality of tubular cooling protrusions;

the annular coolant chamber being concentrically positioned around the working fluid chamber;

the annular coolant chamber comprising a coolant ingress and a coolant egress;

the coolant ingress being in fluid communication with the coolant egress through the cooling space;

a first end of the bellows assembly being annularly connected within the piston chamber adjacent to the heater head;

a second end of the bellows assembly being annularly connected to the displacer piston;

the displacer piston being sealed within the bellows assembly;

each of the plurality of heater fin protrusions comprising an outer casing and a thermally conductive core; and the thermally conductive core being enclosed by the outer casing.

2. The Stirling engine as claimed in claim 1 comprising:
the displacer piston, the cooling bridge and the heater head being concentrically positioned with the cylindrical housing;
the displacer piston and the cooling bridge positioned within the cylindrical housing;
the heater head traversing into the cylindrical housing along the central axis;
the heater head and the cooling bridge being positioned opposite each other along the piston chamber;
the displacer piston being positioned between the heater head and the cooling bridge;
the displacer piston oscillating between the heater head and the cooling bridge;
the displacer piston alternatingly displacing the working fluid between the heater head and the cooling bridge; and
the plurality of cavities alternatingly enveloping the plurality of heater fin protrusions and the plurality of tubular cooler fin protrusions.

3. The Stirling engine as claimed in claim 1 comprising:
the displacer piston being positioned within the piston chamber; and
the heater head traversing into the piston chamber.

4. The Stirling engine as claimed in claim 1 comprising:
each of the plurality of cavities being oriented parallel to the central axis;
each of the plurality of heater fin protrusions being oriented parallel to the central axis; and
each of the plurality of tubular cooler fin protrusions being oriented parallel to the central axis.

5. The Stirling engine as claimed in claim 1 comprising:
the plurality of cavities traversing through the displacer piston; and
one of the plurality of regenerator cores being positioned within each of the plurality of cavities.

6. The Stirling engine as claimed in claim 1, wherein the displacer piston is a free piston design.

7. The Stirling engine as claimed in claim 6 comprising:
a ferrous or magnetic material;
an electrically conductive coil;
the ferrous or magnetic material being integrated into the displacer piston;
the electrically conductive coil being wrapped around the cylindrical housing;
the electrically conductive coil being electrically connected to an electronic control system; and
the electronic control system controlling electrical current flow through the electrically conductive coil in order to produce an electromagnetic field for moving the displacer piston.

8. The Stirling engine as claimed in claim 6 comprising:
a spring;
the spring being connected between the displacer piston and a spring annulus;
the spring annulus being positioned opposite the heater head along the cylindrical housing;
the cylindrical housing comprising a plurality of roller tracks;
each of the plurality of roller tracks being oriented parallel to the central axis;
the plurality of roller tracks being radially distributed around the central axis within the cylindrical housing;
the displacer piston comprising a plurality of rollers;
the plurality of rollers being radially distributed around the central axis on the displacer piston;
the plurality of rollers being engaged to the plurality of roller tracks; and
the plurality of rollers rolling within the plurality of roller tracks in a direction parallel to the central axis.

9. The Stirling engine as claimed in claim 6 comprising:
a spring; and
the spring being wound within the bellows assembly from the first end to the second end of the bellows assembly.

10. The Stirling engine as claimed in claim 6 comprising:
an electrically conductive coil; and
the electrically conductive coil being wound within the bellows assembly from the first end to the second end.

11. A Stirling engine comprising:
a cylindrical housing;
a displacer piston;
a heater head;
a cooling bridge;
a plurality of regenerator cores;
coolant fluid;
a bellows assembly;
the cylindrical housing comprising a piston chamber;
a working fluid being contained within the cylindrical housing;
a central axis centrally traversing through the cylindrical housing;
the displacer piston comprising a plurality of cavities;
the heater head comprising a plurality of heater fin protrusions;
the cooling bridge comprising a plurality of tubular cooler fin protrusions;
the plurality of cavities being arranged in a specific cross sectional geometry;
the plurality of heater fin protrusions being arranged to match the specific cross sectional geometry;
the plurality of tubular cooler fin protrusions being arranged to match the specific cross sectional geometry;
the plurality of cavities traversing through the displacer piston;
the plurality of regenerator cores being centrally positioned within the plurality of cavities;
one of the plurality of regenerator cores being positioned within each of the plurality of cavities;
the displacer piston, the cooling bridge and the heater head being concentrically positioned with the cylindrical housing;
the displacer piston and the cooling bridge positioned within the cylindrical housing;
the heater head traversing into the cylindrical housing along the central axis;
the heater head and the cooling bridge being positioned opposite each other along the piston chamber;
the displacer piston being positioned between the heater head and the cooling bridge,
the displacer piston oscillating between the heater head and the cooling bridge;
the displacer piston alternatingly displacing the working fluid between the heater head and the cooling bridge;
the plurality of cavities alternatingly enveloping the plurality of heater fin protrusions and the plurality of tubular cooler fin protrusions;
the cooling bridge being cooled by a circulatory fluid flow using the coolant fluid;
the cylindrical housing comprising an annular coolant chamber, a piston chamber and a working fluid chamber;

the cooling bridge being positioned between the piston chamber and the working fluid chamber;

the cooling bridge comprising a first circular plate and a second circular plate;

the first circular plate and the second circular plate being concentrically positioned with the cylindrical housing;

the first circular plate and the second circular plate being spaced apart from each other along the central axis;

a cooling space being all empty space enclosed between the first circular plate and the second circular plate;

the plurality of tubular cooling protrusions traversing through the first circular plate and the second circular plate;

the working fluid chamber being in fluid communication with the piston chamber through the plurality of tubular cooling protrusions;

the annular coolant chamber being concentrically positioned around the working fluid chamber;

the annular coolant chamber comprising a coolant ingress and a coolant egress;

the coolant ingress being in fluid communication with the coolant egress through the cooling space;

a first end of the bellows assembly being annularly connected within the piston chamber adjacent to the heater head;

a second end of the bellows assembly being annularly connected to the displacer piston;

the displacer piston being sealed within the bellows assembly;

each of the plurality of heater fin protrusions comprising an outer casing and a thermally conductive core; and the thermally conductive core being enclosed by the outer casing.

12. The Stirling engine as claimed in claim 11 comprising:

the displacer piston being positioned within the piston chamber; and the heater head traversing into the piston chamber.

13. The Stirling engine as claimed in claim 11 comprising:

each of the plurality of cavities being oriented parallel to the central axis;

each of the plurality of heater fin protrusions being oriented parallel to the central axis; and each of the plurality of tubular cooler fin protrusions being oriented parallel to the central axis.

14. The Stirling engine as claimed in claim 11, wherein the displacer piston is a free piston design.

15. The Stirling engine as claimed in claim 14 comprising:

a ferrous or magnetic material;

an electrically conductive coil;

the ferrous or magnetic material being integrated into the displacer piston;

the electrically conductive coil being wrapped around the cylindrical housing;

the electrically conductive coil being electrically connected to an electronic control system; and the electronic control system controlling electrical current flow through the electrically conductive coil in order to produce an electromagnetic field for moving the displacer piston.

16. The Stirling engine as claimed in claim 14 comprising:

a spring;

the spring being connected between the displacer piston and a spring annulus, the spring annulus being positioned opposite the heater head along the cylindrical housing;

the cylindrical housing comprising a plurality of roller tracks each of the plurality of roller tracks being oriented parallel to the central axis;

the plurality of roller tracks being radially distributed around the central axis within the cylindrical housing;

the displacer piston comprising a plurality of rollers;

the plurality of rollers being radially distributed around the central axis on the displacer piston;

the plurality of rollers being engaged to the plurality of roller tracks; and the plurality of rollers rolling within the plurality of roller tracks in a direction parallel to the central axis.

17. The Stirling engine as claimed in claim 14 comprising:

a spring; and the spring being wound within the bellows assembly from the first end to the second end of the bellows assembly.

18. The Stirling engine as claimed in claim 14 comprising:

an electrically conductive coil; and the electrically conductive coil being wound within the bellows assembly from the first end to the second end.

* * * * *